United States Patent [19]

Stern

[11] Patent Number: 4,506,390

[45] Date of Patent: Mar. 26, 1985

[54] MATERNITY GARMENT

[75] Inventor: Marilyn M. Stern, Washington, D.C.

[73] Assignee: Ninth Moon, Washington, D.C.

[21] Appl. No.: 584,874

[22] Filed: Feb. 29, 1984

[51] Int. Cl.[3] ..... A41D 1/14

[52] U.S. Cl. ..... 2/221

[58] Field of Search ..... 2/220, 221, 105, 237, 2/211, 74; 128/519, 534, 579

[56] References Cited

U.S. PATENT DOCUMENTS

| | | | |
|---|---|---|---|
| D. 122,856 | 10/1940 | Rosen | 2/223 |
| D. 127,123 | 5/1941 | Bayor | 2/224 |
| D. 139,359 | 11/1944 | Levitt | D2/223 |
| 1,026,559 | 5/1912 | Brundidge | 2/105 |
| 1,380,605 | 6/1921 | Swantees | 2/105 |
| 2,470,678 | 5/1949 | Auslender | 2/105 |
| 3,013,227 | 12/1961 | Satin | 2/76 |
| 3,089,149 | 5/1963 | Kelleam | 2/76 X |
| 3,093,138 | 6/1963 | Herman | 2/105 |
| 3,143,740 | 8/1964 | Spiegelberg | 2/105 |
| 4,280,229 | 7/1981 | Stein | 2/221 |

*Primary Examiner*—Doris L. Troutman

*Attorney, Agent, or Firm*—Stevens, Davis, Miller & Mosher

[57] ABSTRACT

A maternity garment is disclosed, which comprises an expandable waistband portion of elastically shirred material which completely encircles the garment and a body portion depending from the expandable portion. The expandable portion has a narrower vertical extent at the rear portion of the garment, and a wider vertical extent which swoops down at the front portion of the garment to form a pouch which supports the lower portion of a woman's stomach. The expandable portion is constructed to be width-wise expandable and contractable, but not vertically expandable. The degree of width-wise expansion is controlled by the type of stitching and elastic shirring employed so as not to be too tight or too loose, at any stage of pregnancy. The stitching of the elastically shirred waistband portion is arranged to prevent fold-over or ruffling of the upper edge of the garment.

6 Claims, 6 Drawing Figures

FIG. 4
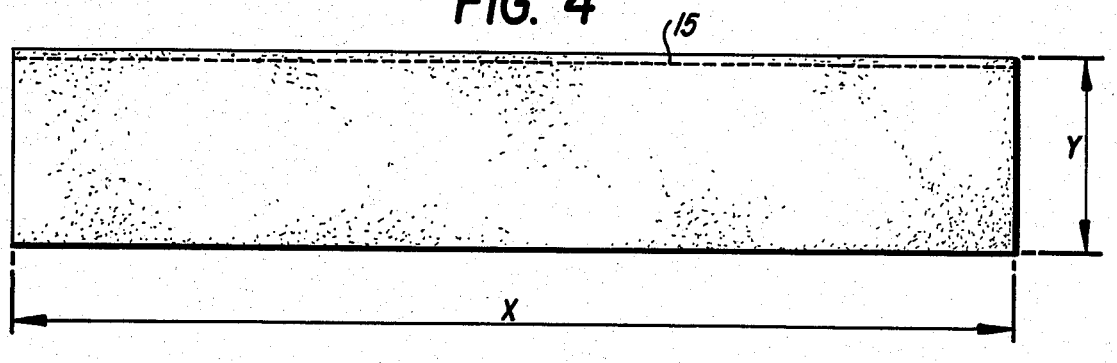
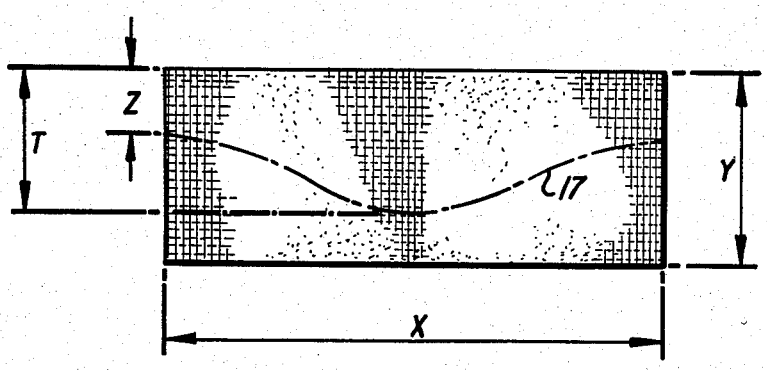
FIG. 5
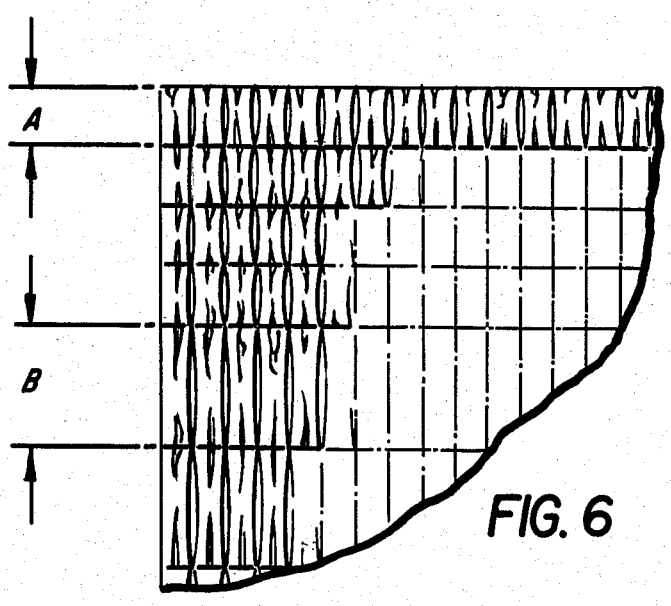
FIG. 6

MATERNITY GARMENT

BACKGROUND OF THE INVENTION

1. Field of the Invention

The present invention is directed to a maternity garment which provides a high degree of wearer comfort throughout a pregnancy, and which looks attractive and is still usable even after a pregnancy.

2. Discussion of the Prior Art

Because a woman's body changes significantly during pregnancy, there is a need for comfortable clothing which can conform to these changes and yet be attractive. Several attempts have been made at providing maternity garments, such as pants and skirts, which conform to a woman's body throughout the term of pregnancy. Typically, such garments have a generally rectangular shaped expandable knit (stretch) panel extending from side-to-side across the front thereof, which allows the stomach and waist area to expand. The sole function of the panel is to cover that area of the body throughout the pregnancy. It provides no support for the wearer nor does it assist in supporting the garment itself. The garment is supported by a narrow elastic band, attached to the top of the panel, which encircles the garment at waist level. The garment relies totally on the concentrated area pf this narrow band to hold itself up. This construction presents numerous problems for a pregnant wearer.

As a pregnancy progresses the waistband has the largest relative circumference of the garment so that the elastic band has to be tight enough to hold the skirt up and counteract the natural tendency for the waistband to slip down. The narrow elatic band necessary to support the garment does not expand sufficiently to remain comfortable. The elastic ratio of the elastic band is less than the proportionate dimensional change of the circumference of a pregnant wearer's stomach. Since the elastic band is sized to attempt to accommodate all stages of a pregnancy, it is loose during the early stages and the garment is not securely supported. Conversely, during the latter stages, this narrow band is stretched too tght and causes great discomfort as it tends to abrade and cut into a pregnant wearer.

The panel easily accommodates the changes in shape of a pregnant woman's body, but provides no support for the lower portion of the stomach. As the panel itself is not very elastic, it does not contract or hug under the stomach. The bottom of the panel is pulled away from the body by the weight of the garment and falls from the fullest part of the stomach. The changing position of the bottom of the panel alters the drape of the garment. This makes it difficult to keep the hem line even and increases the fullness of the body of the garment, resulting in a less flattering fit. The panel, as it is rectangular in shape, extends over the hip bone area where little or no expansion is needed, unnecessarily increasing the total area of the panel. Moreover, the front panel is typically constructed of a different material (knitted) than the ramainder of the garment (woven) making it unattractive. The dye lot of the panel and therefore its color is different from that of the body of the garment, further increasing its unattractiveness. The panel requires a corresponding maternity top that covers and conceals the entire panel area, thereby restricting the styling of the top. As a further consequence of the panel's unattractiveness, once a pregnancy is over the garment is no longer used.

At least one attempt has been made to provide a more comfortable and attractive maternity garment by discarding the expandable front panel in favor of an expandable waistband which is wider than a conventional waistband and which completely encircles the garment, as described in U.S. Pat. No. 4,280,229. However, the ribbed knitted waistband does not provide any support for the lower portion of a woman's stomach, so that the garment tends to be less comfortable to wear. Also, the drape of the garment changes as the pregnancy progresses, since the ribbed knitted waistband pulls away from the body at the bottom of the stomach, resulting in an unflattering greater fullness in the body of the garment. The ribbed knitted waistband used in the garment described in this patent is formed of a material which is different from that of the remainder of the garment, which tends to make the garment unattractive so that it will not be used once a pregnancy is over. In addition, the rectangular shape of the waistband restricts the styling of corresponding maternity tops.

SUMMARY OF THE INVENTION

An object of the present invention is the provision of a maternity garment which is comfortable to wear throughout a pregnancy, which is attractive, and which is usable even after a pregnancy is over.

Another object of the invention is the provision of a maternity garment which has a waistband portion which securely supports the garment and which never abrades or cuts a wearer, even in the last stages of pregnancy.

Another object of the invention is the provision of a maternity garment which fits well and provides comfortable stomach support to a wearer throughout all stages of a pregnancy.

Another object of the invention is the provision of a maternity garment which has a waistband portion which permits the drape of the body of the garment to remain unchanged throughout a pregnancy.

Another object of the invention is the provision of a waistband portion which permits greater latitude in the styling of complimentary garments.

These and other objects, advantages and features of the invention are provided by a maternity garment which comprises an expandable and contractable waistband portion of elastically shirred material which completely encircles the garment and a body portion depending from the waistband portion. The waistband portion has a narrower vertical extent at the rear portion of the garment, and a wider vertical extent which swoops down at the front portion of the garment to form a pouch which cups and supports the lower part of a woman's stomach. The waistband portion is constructed to be width-wise expandable and contractable, but not vertically expandable. The degree of width-wise expansion and contraction is controlled by the length and type of stitch, the spacing of the rows of stitching and the gauge and type of elastic thread employed in the elastic shirring. The expandable waistband portion is therefore not too tight or too loose, at any stage of pregnancy. Open yardage forming the waistband portion is shirred at an optimum ratio of slightly greater than two-to-one to provide the desired degree of width-wise expansion. The stitching of the elastically shirred waistband portion is also arranged to prevent fold-over or ruffling of the upper edge of the garment. Since the invention does not use a narrow encircling elastic band, abrasion and cutting of a wearer is entirely avoided.

BRIEF DESCRIPTION OF THE DRAWINGS

The invention will be better understood by reference to the accompanying drawings, in which:

FIG. 4 illustrates in front view a piece of fabric used to construct the waistband portion;

FIG. 5 illustrates in front view the fabric of FIG. 4 after shirring and with a cut line for the waistband portion; and, FIG. 6 illustrates in side view an enlargement of a portion of the waistband.

DETAILED DECRIPTION OF THE INVENTION

Figure 1:
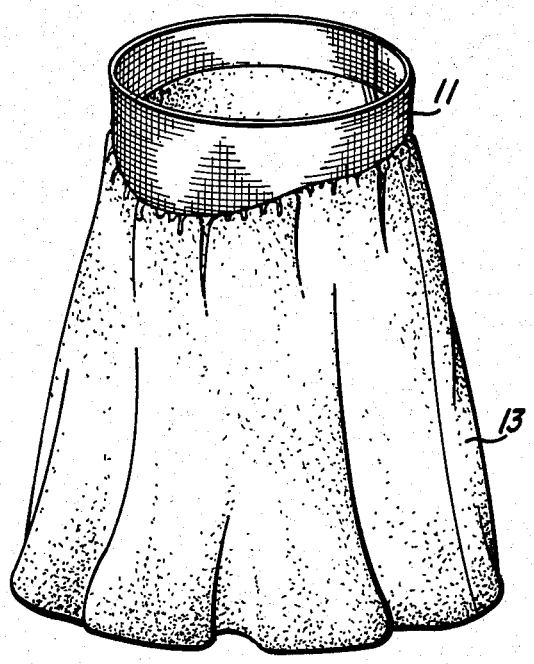
FIG. 1 illustrates in perspective view a maternity garment of the invention.
Figure 2:
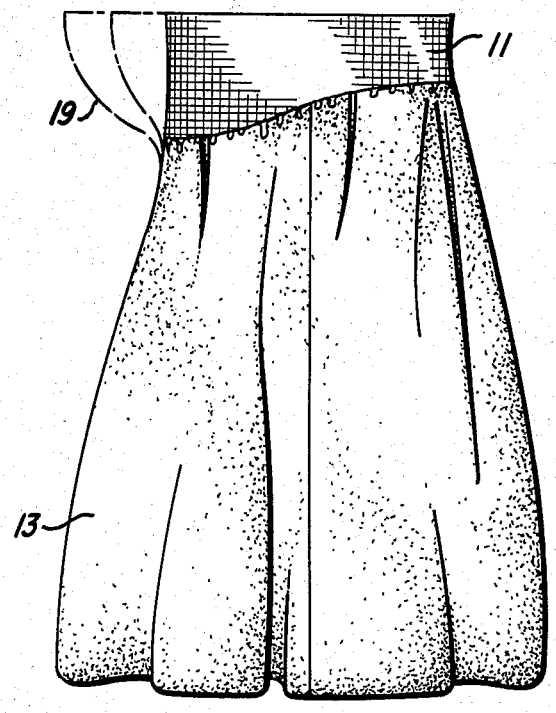
FIG. 2 illustrates in side view the maternity garment of the invention.

FIGS. 1 and 2 illustrate a maternity garment constructed in accordance with the teachings of the invention. It includes a waistband portion 11 and a body portion 13. The garment illustrated is a skirt; however, other types of maternity garments, such as slacks, can also be constructed. To simplify subsequent description, a skirt will be described.

The waistband portion completely encircles the garment and is radially expandable, as illustrated in FIG. 2. It is formed of a strip of open yardage material approximately 60" long and 9" wide, as shown in FIG. 4. A hem is formed along a top edge thereof by folding the top edge and stitching along line 15 (FIG. 4) so that the material strip is reduced to a size X×Y of about 60"×8". This material strip is then elastically shirred (stitched longitudinally) with stretched elastic thread to form the waistband material shown in FIG. 5, having a X×Y dimension of approximately 28"×8". The stitch used is a single thread chain stitch and the elastic thread is known in the trade as 3M. The first four longitudinal rows of stitching (those closest to the top edge 11) are spaced approximately 3/16" apart ("A" in FIG. 6), while the remaining rows of stitching are approximately 3/8" apart ("B" in FIG. 6). The stitches are all the same size and hit in the same spacing. The smaller spacing between the first four rows of stitching prevents ruffling or "fold over" of the upper edge of the garment during use. Stitching of the hemmed open yardage to produce the elastically shirred waistband material can be accomplished by a multi-needle chain stitching machine, which is known in the trade. With this stitching, the open yardage is elastically shirred at a slightly greater than a two-to-one ratio (60" to 28"=approximately a 2.14 to 1 ratio). The resultant waistband material is expandable horizontally (in the radial direction) when fastened to a garment, but not vertically.

The elastically shirred waistband material is then cut along the cut line 17, shown in FIG. 2. One portion at each end of the waistband material is cut to a height Z of approximately $4\frac{3}{8}$", while a central portion at the center is cut on a curve from each of the end portions to form a pouch 19 having a maximum height T of approximately $7\frac{1}{4}$".

Figure 3:
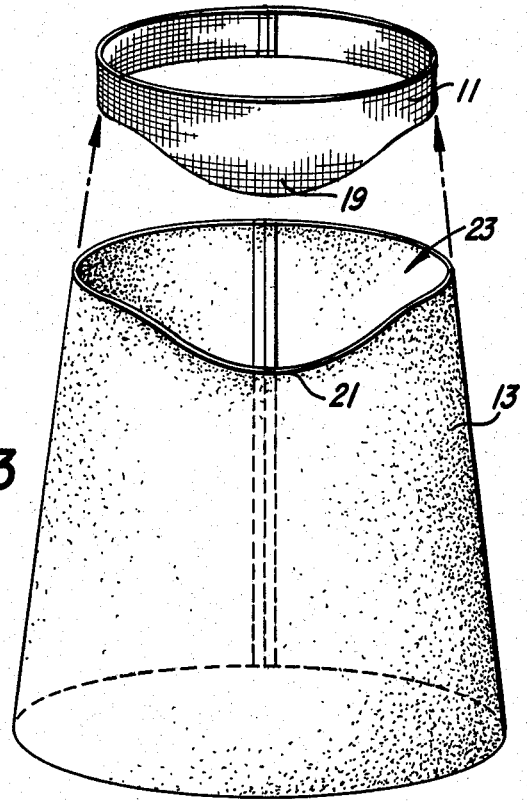
FIG. 3 illustrates in front view the attachment of the waistband portion to a body portion of the maternity garment.

The cut, elastically shirred panel is then sewn into a tube, with the center back edges being joined together to form the waistband portion of the garment (FIGS. 1–3).

A skirt body portion is formed from one or more skirt panels which are sewn together to form the body shape shown in FIG. 3. The front portion of the skirt body includes a cut-out area 21 which conforms to the pouch 19 formed in the elastic waistband portion. The opening 23 formed at the top of the body portion has a circumferential dimension larger than that of the elastically shirred waistband portion 11 when relaxed. To construct the garment, the waistband portion is stretched and sewn to the upper edge of the body portion of the garment. Subsequent relaxation of the shirred tube causes the skirt body 13 to be gathered, as shown in FIGS. 1 and 2. The finished skirt dimensions are typically a 28" waistband circumference, and a 30" overall length.

As shown in FIGS. 1–3, the waistband portion 11 of the garment has a wider vertical extent at the front of the garment than at the rear and the front portion of the waistband further includes a curved downwardly extending pouch 19. The tapering of the elastically shirred waistband specifically confines the expandability to that area where it is needed. Additionally, the tapering reduces the total area of the waistband, thereby permitting greater latitude in the design of corresponding maternity tops.

The elastically shirred waistband portion also has a natural automatic contraction, which is not true of some types of expandable materials, such as a regular knitted structure. As a result of the elastic shirring, the pouch 19 cups the lower portion of a woman's stomach and contours itself to fit it, and acts as a sling-like support which provides added comfort to a wearer. This cup-like action of the pouch provides a wearer with a custom fit and a feeling of security. As the pouch acts independently from the body of the garment, the drape of the garment remains unchanged. The cup-like action of the pouch permits the body of the garment to always hang from the same position below the bulge of the stomach, close to the legs. This results in a slimmer silhouette and a smaller hem circumference. Additionally, the garment maintains an even horizontal hem level with no hike-up in the front.

The waistband portion 11, being elastically shirred, can be formed of the same woven or knitted material which is used for the body portion of the skirt so that the skirt as a whole has a more attractive and uniform appearance and looks like a traditional garment.

The approximately two-to-one shirring ratio is compatible with the growing dimension of a pregnant wearer's stomach. It provides adequate support for the garment in the earlier stages of pregnancy and easily stretches to comfortably accomodate the maximum full term stomach circumference. The elastic ratio of the elastic shirring is considerably greater than the proportional change of the pregnant wearer's stomach. The shirring ratio can also be greater than the slightly greater than two-to-one ratio discussed above to provide even more "hug" to the garment, if needed or desired. As the hug, and therefore the support for the garment, is distributed over the entire waistband area, the waistband portion 11 does not present an encircling narrow elastic band, as in the prior art garments. This wide distribution and the waistband's ability to separately expand at each of the encircling rows of stitching ensures that it will not abrade or cut a wearer at any stage of a pregnancy.

Although a skirt has been shown and described, it should be appreciated, as noted above, that the waistband material can also be attached to the top of a body portion configured as a pair of slacks. Accordingly, the invention is not to be construed as limited by the foregoing description, but is only limited by the scope of the claims appended hereto.

I claim:

1. A maternity garment comprising:

a tube-like waistband portion having a front and back and a vertical extent which is narrower at said back and wider at said front, said waistband portion having a pouch-like vertical extension at said front and being elastic and expandable and contractable only in a radial direction; and a body portion connected with and extending downwardly from said waistband portion, said body portion forming the configuration of said garment.

2. A maternity garment as in claim 1, wherein said waistband portion is formed of an elastically shirred material which is stitched circumferentially of said garment with elastic thread.

3. A maternity garment as in claim 2, wherein said elastically shirred material includes a plurality of vertically spaced circumferential stitches arranged in rows, said stitches all being of the same size, the spacing of a first predetermined number of rows of said stitches adjacent to a top edge of said garment being less than the spacing between the remaining rows of said stitches.

4. A maternity garment as in claim 1, wherein said waistband portion and body portion are formed of the same fabric material.

5. A maternity garment as in claim 2, wherein said material is elastically shirred with a ratio which is at least slightly greater than two-to-one.

6. A maternity garment as in claim 5, wherein said material is elastically shirred with a ratio of approximately 2.14 to 1.

* * * * *